US011355843B2

(12) United States Patent
Eleftheriades et al.

(10) Patent No.: US 11,355,843 B2
(45) Date of Patent: Jun. 7, 2022

(54) PERIPHERALLY EXCITED PHASED ARRAYS

(71) Applicant: George V. Eleftheriades, Scarborough (CA)

(72) Inventors: George V. Eleftheriades, Scarborough (CA); Ayman H. Dorrah, Toronto (CA)

( * ) Notice: Subject to any disclaimer, the term of this patent is extended or adjusted under 35 U.S.C. 154(b) by 217 days.

(21) Appl. No.: 16/453,924

(22) Filed: Jun. 26, 2019

(65) Prior Publication Data

US 2020/0259257 A1 Aug. 13, 2020

Related U.S. Application Data

(60) Provisional application No. 62/802,786, filed on Feb. 8, 2019.

(51) Int. Cl.
*H01Q 3/36* (2006.01)
*H01Q 1/24* (2006.01)

(52) U.S. Cl.
CPC ..... *H01Q 3/36* (2013.01); *H01Q 1/241* (2013.01)

(58) Field of Classification Search
CPC combination set(s) only.
See application file for complete search history.

(56) References Cited

U.S. PATENT DOCUMENTS 3,803,625 A 4/1974 Nemit
2018/0090816 A1* 3/2018 Mow ..... H01Q 9/0421
2019/0252799 A1* 8/2019 Smith ..... H01Q 13/10
2019/0317177 A1* 10/2019 Ertan ..... G01S 3/46
2020/0176889 A1* 6/2020 Rojanski ..... H01Q 21/205
2020/0235471 A1* 7/2020 Pu ..... H01Q 9/30

OTHER PUBLICATIONS

Abbaspour-Tamijani and Sarabandi, An Affordable Millimeter-Wave Beam-Steerable Antenna Using Interleaved Planar Subarrays.
Rocca, Oliveri, Mailloux, and Massa, "Unconventional phased array architectures and design methodologies: A Review," Proceedings of the IEEE, vol. 104, No. 3, pp. 544-560, Mar. 2016.
Haupt, "Thinned arrays using genetic algorithms," IEEE Trans. on Antennas and Propag., vol. 42, No. 7, pp. 993-999, Jul. 1994.

(Continued)

*Primary Examiner* — Junpeng Chen
(74) *Attorney, Agent, or Firm* — Island IP Law; Stephen R. Burri

(57) ABSTRACT

The present invention introduces a new phased array, called the peripherally-excited phased array (PEX-PA). The PEX-PA comprises an electrically large metallic cavity which is excited by weighted antenna sources only at its periphery. The top surface of the cavity is patterned with a suitable configuration of apertures (slots) whereas the cavity is filled with a dielectric material. The (PEX-PA) is capable of beam scanning, one or multiple beams, over a large number of directions in air but with a drastically reduced number of passive or active phase shifters. Specifically, the PEX-PA scales the number of phase-shifters according to the circumference of the cavity and not its area, as usually the case in a conventional phased array.

20 Claims, 8 Drawing Sheets

(56) References Cited

OTHER PUBLICATIONS

Redlich, "Iterative least-squares synthesis of nonuniformly spaced linear arrays," IEEE Trans. on Antennas and Propag., vol. 21, No. 1, pp. 106-108, Jan. 1973.
Trucco and Murino, "Stochastic optimization of linear sparse arrays," IEEE Journal of Oceanic Engineering, vol. 24, No. 3, pp. 291-299, Jul. 1999.
Mailloux, "A Low-Sidelobe Partially Overlapped Constrained Feed Network for Time-Delayed Subarrays," IEEE Trans. on Antennas and Propag., vol. 49, No. 2 pp. 281-291, Feb. 2001.
Fante, "Systems study of overlapped subarrayed scanning antennas," IEEE Trans. on Antennas and Propag., vol. 28, No. 5, pp. 668-679, Sep. 1980.
Skobelev, "Methods of constructing optimum phased-array antennas for limited field of view," IEEE Antennas and Propag Mag., vol. 40, No. 2, pp. 39-50, Apr. 1998.
Mailloux, "An Overlapped Subarray for Limited Scan Application," IEEE Antennas and Propag. Mag., pp. 487-489, May 1974.
Epstein, Wong, and Eleftheriades, "Cavity-excited Huygens' metasurface antennas for near-unity aperture Illumination efficiency from arbitrarily large apertures," Nature Communications, vol. 7, p. 10360, 2016.
Wong and Eleftheriades, "Active Huygens' metasurfaces for RF waveform synthesis in a cavity," in 2016 18th Mediterranean Electrotechnical Conference (MELECON), pp. 1-5, Cyprus, Apr. 2016.
"Experimental demonstration of the Huygens' box: Arbitrary waveform generation in a metallic cavity," in 2018 IEEE International Symposium on Antennas and Propagation USNC/URSI National Radio Science Meeting, pp. 1893-1894, Boston, Jul. 2018.
Lo and Lee, "A Study of Space-Tapered Arrays," IEEE Antennas and Propag. Mag., vol. AP-14, No. 1, pp. 22-30, Jan. 1966.
Wong and Eleftheriades, "Active Huygens' Box: Metasurface-Enabled Arbitrary Electromagnetic Wave Generation Inside a Cavity," arXiv:1810.05998v1 [physics.app-ph] Oct. 14, 2018.

* cited by examiner

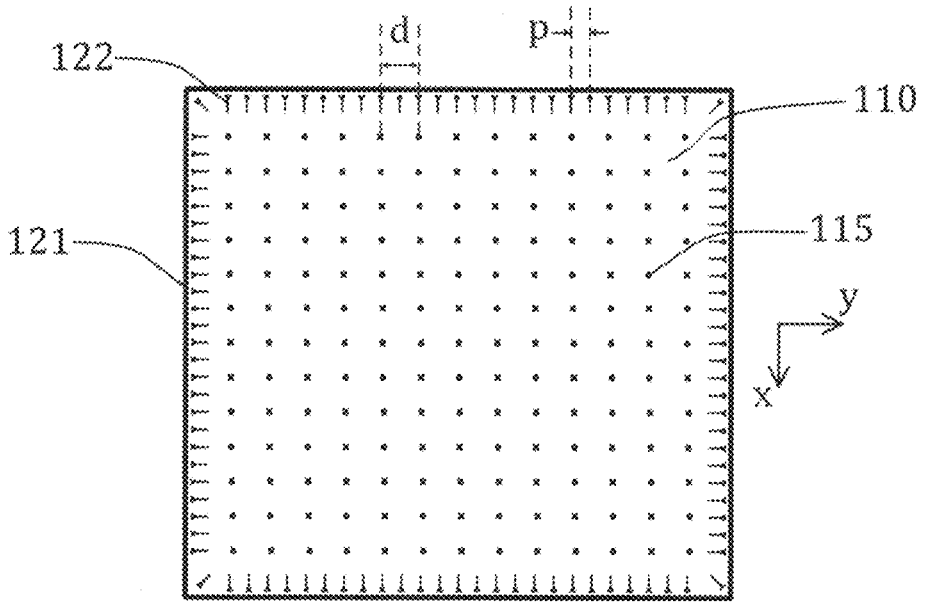
FIG. 1A
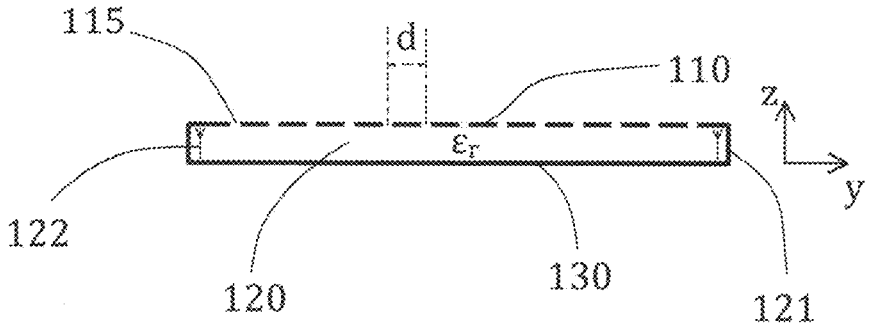
FIG. 1B
FIG. 1

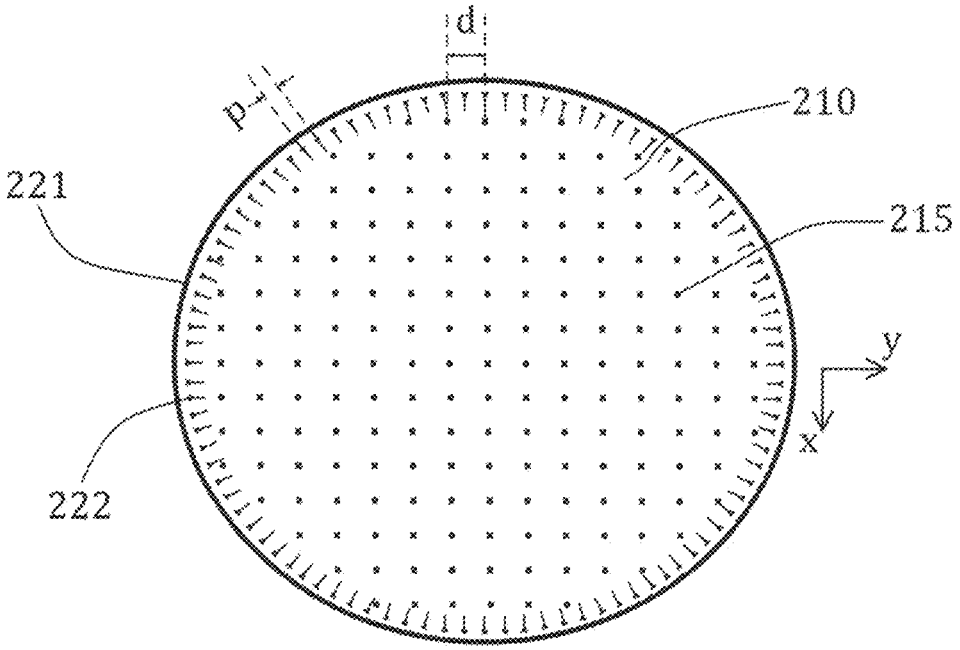
FIG. 2A
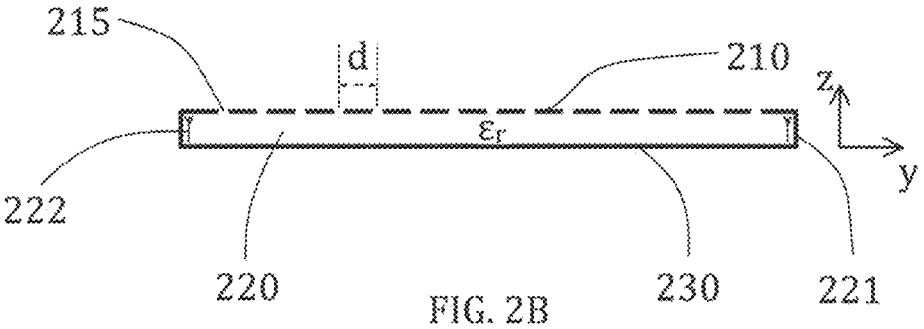
FIG. 2B
FIG. 2

PERIPHERALLY EXCITED PHASED ARRAYS

FIELD OF THE INVENTION

The present invention relates to electronically beam-steerable antenna arrays (phased arrays). Such phased arrays find application in broadband wireless telecommunications, defense, satellite communications, radars, imaging, and other technologies. More specifically, the invention describes a class of phased arrays that require a drastically reduced number of active antenna elements compared to state-of-the-art phased arrays. This leads to a dramatic reduction in the required complexity, power and cost of the disclosed phased array embodiments.

BACKGROUND OF THE INVENTION

Antenna phased arrays can be used to form and to electronically steer electromagnetic-wave beams in space. Phased arrays have been used in radars for many years, primarily for defense applications, to track moving targets such as aircraft and incoming threats. In recent years, with the advent of broadband telecommunications at microwave and millimeter-wave frequencies, low-earth orbit satellite communications, autonomous vehicle radar sensors, high-resolution imaging, and other technologies, phased arrays are finding their way into more mainstream commercial applications. However, the cost of a phased array is still prohibitive for such commercial applications. This is because each antenna element in a phased array requires at least one phase shifter to be integrated with it, and often a complete transceiver module is required. With a typical size of 16×16 elements, 256 phase shifters or transceivers would be needed to realize a conventional phased array, thus leading to a significant cost, power requirement, heat generation and feeding complexity. This number of phase shifters or transceivers scales according to the area of the radiating aperture of the phased array. Even with the availability of low-cost complimentary metal-oxide-semiconductor technology well into the millimeter-wave spectrum, the cost, complexity, cooling and power requirements are still severe for enabling phased arrays to penetrate mass market commercial applications.

A key strategy for such phased-array ameliorations is the use of fewer active antenna elements (phase shifters or transceivers) to cover a given aperture size, and hence produce a given desired directivity. The issue though is that ideally, an antenna inter-element array spacing of $0.5\lambda_0 \times 0.5\lambda_0$ is required to avoid the formation of grating lobes in air as the array scans (where $\lambda_0$ is the free-space wavelength). In the prior art, many techniques have been proposed to achieve such a reduction of the number of active elements.

Such techniques include thinned and sparse arrays in which some elements are not excited or are removed from a periodic grid, typically using a suitable optimization technique. In some scenarios, the periodic grid is dropped entirely and the elements are arranged in a sparse manner. Another approach is by means of interleaved or stacked sub-arrays, also known as overlapped arrays. However, such techniques either lead to an insignificant reduction of the required antenna elements or result in a severe reduction of the scanning angle range from broadside before the appearance of grating lobes. Some antenna key parameters such as directivity, beam width and sidelobe levels are often compromised by these techniques. They can also complicate the architecture of the feeding network.

SUMMARY OF THE INVENTION

In this present invention, we disclose a new solution to the problem of reducing the number of active antenna elements in a phased array. In the invented hardware embodiments, an otherwise passive 2D antenna array is only excited by active elements in its periphery. This idea is inspired by the recent concept of the Huygens' metasurface. These metasurfaces are based on the Huygens/Schelkunoff equivalence principle in which the fields in a given region can be completely controlled by appropriate electric and magnetic currents on the boundary surface of that region, as described in A. Epstein and G. V. Eleftheriades, "*Advanced Huygens' Metasurfaces for Beam Manipulation and Antenna Applications*", Antenna Engineering Handbook, 5th Edt., Edited by John Volakis, McGraw-Hill, pp. 1299-1343, December 2019.

For the specific implementation of these Peripherally Excited (PEX) phased arrays (PAs), we hereby use a metallic cavity, lined by active sources, which can be used to synthesize arbitrary interior field patterns. The cavity is perforated with apertures in a specific and deliberate manner to allow for the formation of radiated beams. In this way, the formed beams can be scanned by controlling the amplitude and/or phase of the sources only at the periphery of the cavity.

The proposed invention leads to a scaling of the number of active elements in a 2D phased array in proportion to the circumference of the array and not its area, thus resulting in a drastic reduction of the number of active antenna elements needed. In addition, the complexity of the required antenna feeding network is greatly simplified. All these ameliorations lead to a drastic reduction of the overall cost and complexity required to realize a large scanning phased array.

BRIEF DESCRIPTION OF THE DRAWINGS

Some embodiments of the present invention are illustrated by way of example and are not limited by the figures of the accompanying drawings:

FIG. 1 depicts a top-view (FIG. 1A) and a side-view (FIG. 1B) of a square-cavity embodiment of a Peripherally Excited (PEX) phased array showing all the essential constituent elements, according to an aspect of the invention;

FIG. 2 depicts a top-view (FIG. 2A) and a side-view (FIG. 2B) of a circular-cavity embodiment of a Peripherally Excited (PEX) phased array showing all the essential constituent elements, according to an aspect of the invention;

DETAILED DESCRIPTION OF THE PREFERRED EMBODIMENTS

Figure 3:
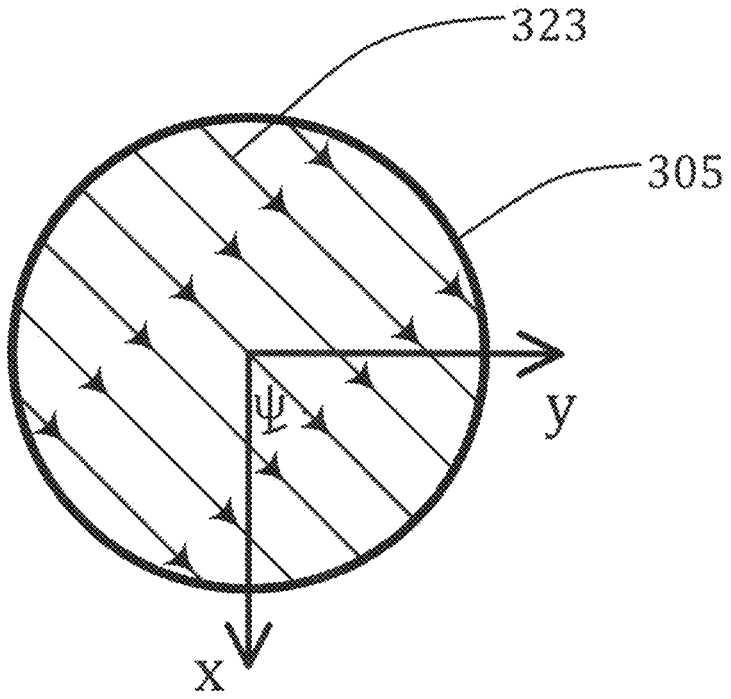
FIG. 3 illustrates a plane wave inside the cavity of the PEX phased array making an angle $\psi$ with the x-axis where $\psi$ is determined by the weights on the peripheral sources.

There is provided a Peripherally Excited Phased Array (PEX-PA) which is capable of beam steering over a large number of directions in air but with a drastically reduced number of passive or active phase shifters and/or transceivers. Specifically, the PEX-PA scales the number of phase shifters with the circumference of the cavity, and not its area as is usually the case for conventional phased arrays. The PEX-PA comprises an electrically large metallic cavity which is excited by weighted and/or phased antenna-element sources only at its periphery. The top surface of the cavity is patterned with a suitable grid of small apertures whereas the cavity is filled with a dielectric material.

Single or multiple independently steered beams may be generated by the PEX-PA with equal or varying weights.

A PEX-PA with an enhanced beam-scanning range is possible by mounting the cavity on a moving pedestal. The pedestal can be rotated clockwise or counter-clockwise by discrete or continuous steps using a motor.

A PEX-PA with an enhanced beam-scanning range is also possible by incorporating a variable dielectric medium inside the metallic cavity. The dielectric permittivity $\in_r$ is, electronically or otherwise, controlled using materials such as ferromagnetic or ferroelectric, liquid crystals and artificial dielectrics loaded with electronically variable components.

FIG. 1 shows an example embodiment of the invented peripherally excited (PEX) phased array. It comprises a square metallic cavity made of a top metallic plate 110, side metallic walls 121, and a bottom metallic plate 130. The PEX cavity is filled with a dielectric 120, and the top plate is perforated with square apertures 115 at a periodicity of d.

Peripheral antenna-element sources 122 are placed along the periphery of the square PEX cavity to excite appropriate waves inside the cavity. These antenna-element sources can excite arbitrary waves that include, and are not limited to, single or multiple plane waves. Examples of these antenna-element sources include monopole and loop antennas, typically spaced p=0.5$\lambda$ apart, where $\lambda$ is the wavelength inside the metallic cavity. In order to avoid grating lobes in air, it is preferred to space the apertures 115 in a square grid of period d less than 0.5$\lambda_0$ (where $\lambda_0$ is the free-space wavelength). The grid is not limited to a square. The shape of the grid may be rectangular, triangular and hexagonal (honeycomb), among other shapes.

FIG. 2 shows an additional example embodiment of the invented PEX phased array. It comprises a circular metallic cavity made of a top metallic plate 210, side metallic walls 221, and a bottom metallic plate 230. The PEX cavity is filled with a dielectric 220, and the top plate is perforated with square apertures 215 at a periodicity of d.

Peripheral antenna-element sources 222 are placed along the periphery of the circular PEX cavity to excite appropriate waves inside the cavity. These antenna-element sources can excite arbitrary waves that include but are not limited to, single or multiple plane waves. Examples of these antenna-element sources include monopole and loop antennas, typically spaced p=0.5$\lambda$, apart, where $\lambda$ is the wavelength inside the metallic cavity.

In a preferred embodiment, the circular cavity is filled with a dielectric material 220 having a relative permittivity $\in_r$=4.4. Such an arrangement can produce arbitrary, single or multiple, plane waves within the cavity, individually having a wave-vector ($k_{xd}$, $k_{yd}$) making an angle $$\psi = \tan^{-1}\frac{k_{yd}}{k_{xd}}$$

with the x-axis.

As shown in FIG. 2, the top plate 210 of the cavity is perforated with small apertures (slots) 215 to allow radiation to leak out of the cavity. In order to avoid grating lobes in air, it is preferred to space the apertures 215 in a square grid of period d less than 0.5$\lambda_0$ (where $\lambda_0$ is the free-space wavelength). The grid is not limited to a square. The shape of the grid may be rectangular, triangular and hexagonal (honeycomb), among other shapes.

The individual apertures are not restricted to be all of the same shape and/or size. Modulation of the aperture shape and/or size throughout the top plate of the PEX cavity can be leveraged to provide additional beamshaping functionalities and sidelobe level control.

FIG. 3 depicts an example plane wave 323 excited inside the PEX cavity 305 along an arbitrary azimuthal direction $\psi$.

Figure 4:
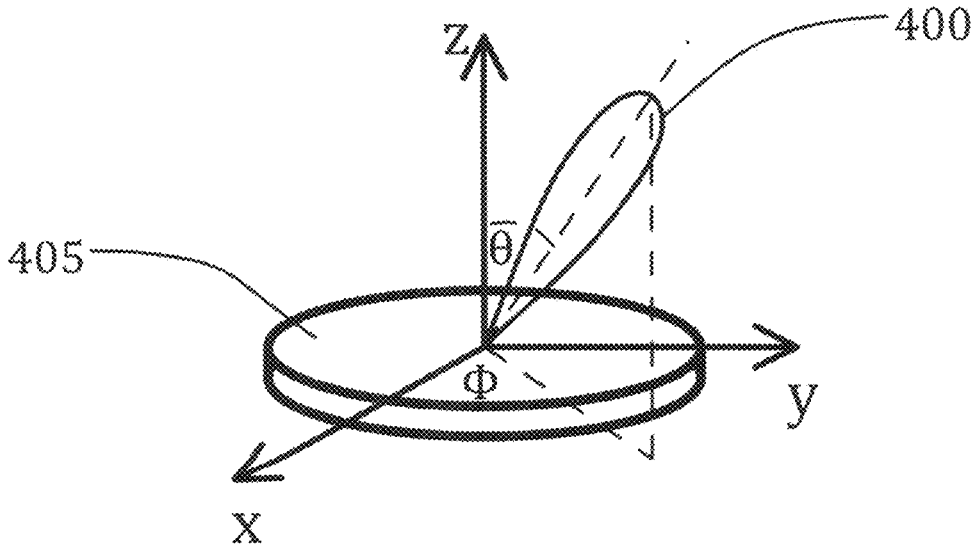
FIG. 4 illustrates a beam radiating in air and making angles ($\phi$, $\theta$) with the x and z axes respectively.

FIG. 4 shows an example of the generated beam 400 from the PEX cavity 405. The beam-pointing direction ($\phi$, $\theta$) for the example of a square aperture grid is governed by the following equations:

$$\sqrt{\epsilon_r}\cos(\psi) = \cos(\phi)\sin(\theta) - n\frac{\lambda_0}{d} \quad (1)$$

$$\sqrt{\epsilon_r}\sin(\psi) = \sin(\phi)\sin(\theta) - m\frac{\lambda_0}{d} \quad (2)$$

where $\psi$ is the angle that the plane wave 323 inside the cavity 305 makes with the x-axis. As shown in FIG. 4, $\phi$ is the azimuthal angle that the radiated pencil beam makes with the x-axis, and $\theta$ is the elevation angle that the radiated pencil beam makes with the z-axis. The plane wave azimuthal direction inside the PEX cavity measured from the x-axis is denoted by ψ. In its turn, this angle ψ is controlled by the phase on the peripheral sources 122 or 222. Also (n,m) are integers that signify the Floquet modes that can radiate. A typical but non-restrictive choice of the parameters would be $\in_r$=4.4 with d=λ (where λ is the wavelength inside the metallic cavity), thus allowing one of the (m,n) ∈(−1,0), (0, −1), (−1,−1) Floquet modes to radiate for the different plane wave directions (ψ).

The apertures are excited by the underlying plane wave 323 ($k_{xd}$, $k_{yd}$). This implies that in principle the apertures are uniformly illuminated leading to a high directivity. On the other hand, it is understood that equations (1), (2) imply that the possible radiation angles φ and θ are constrained. Nevertheless, a great range of scanning angles is still allowed.

Figure 5:
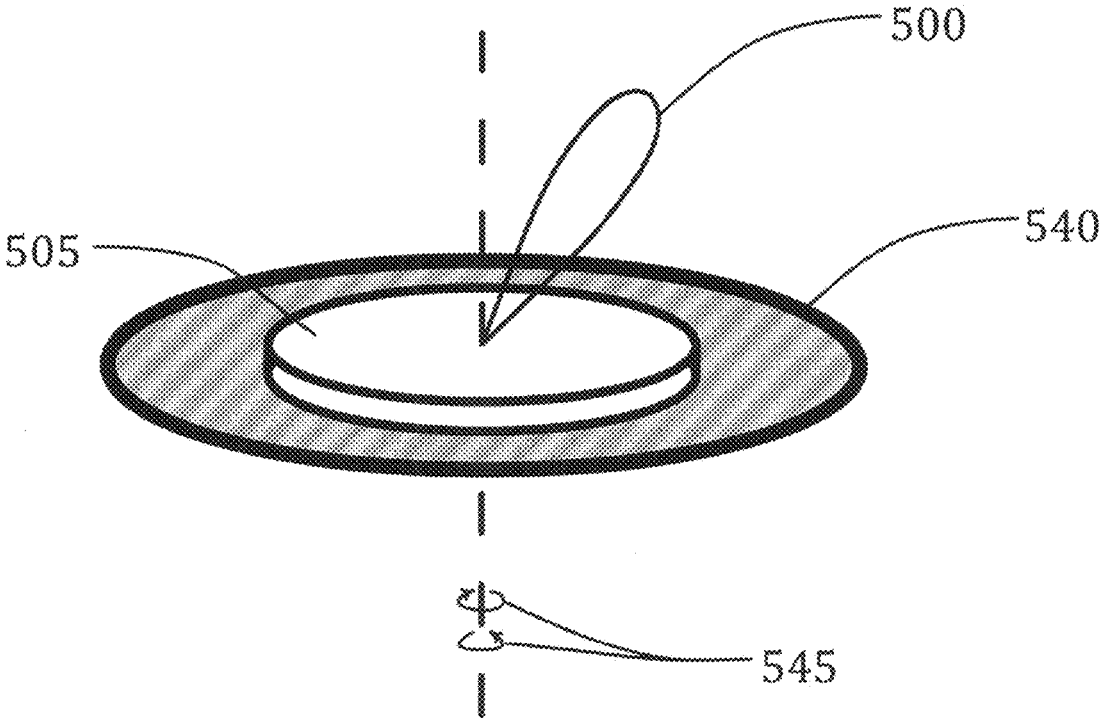
FIG. 5 shows a PEX phased array device that is situated on a moving pedestal controlled by a motor that can be rotated clockwise or counter-clockwise by discrete or continuous steps, according to an aspect of the invention.
Figure 6:
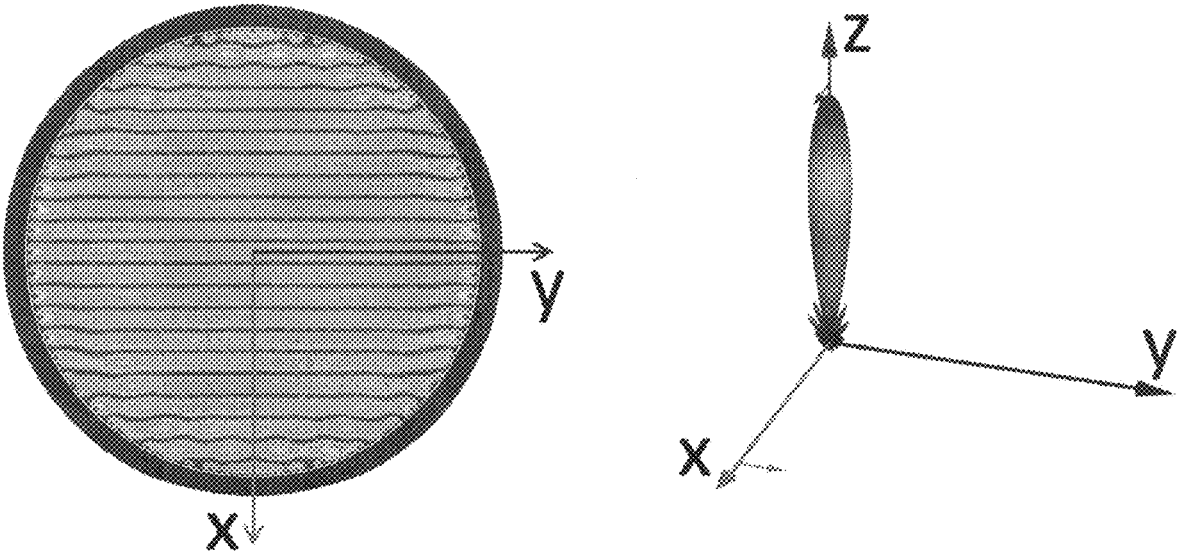
FIG. 6 illustrates an example beam that is formed by a circular-cavity PEX phased array at broadside ($\phi=0°$, $\theta=0°$), and the corresponding plane wave that is formed in the cavity for $\psi=0°$.
Figure 7:
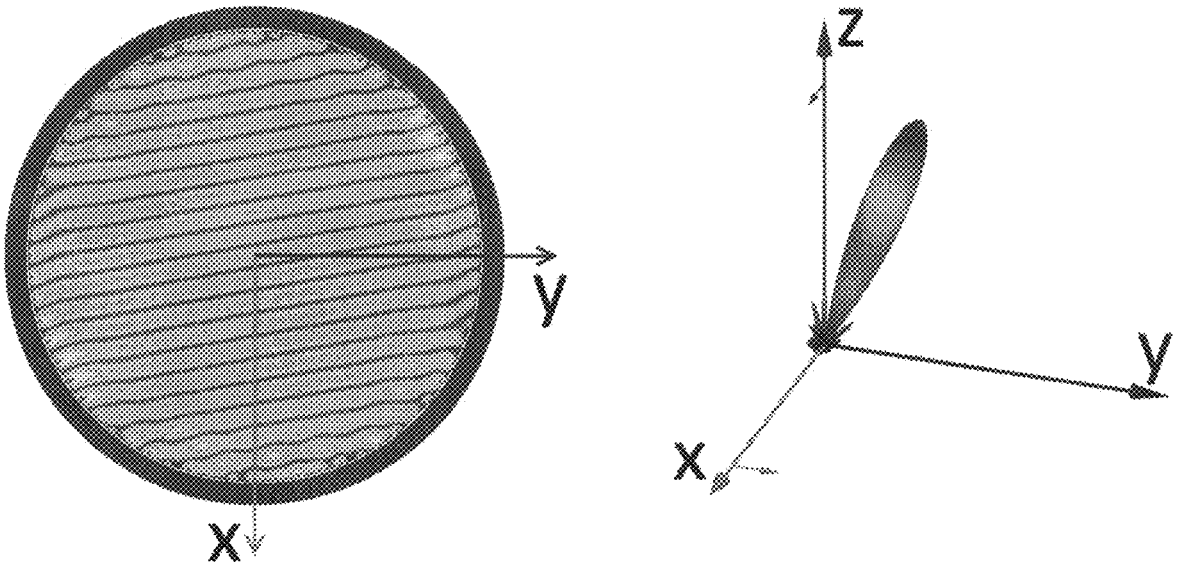
FIG. 7 illustrates an example beam that is formed by a circular-cavity PEX phased array at a tilted angle ($\phi=95°$, $\theta=21°$), and the corresponding plane wave that is formed in the cavity for $\psi=10°$.
Figure 8:
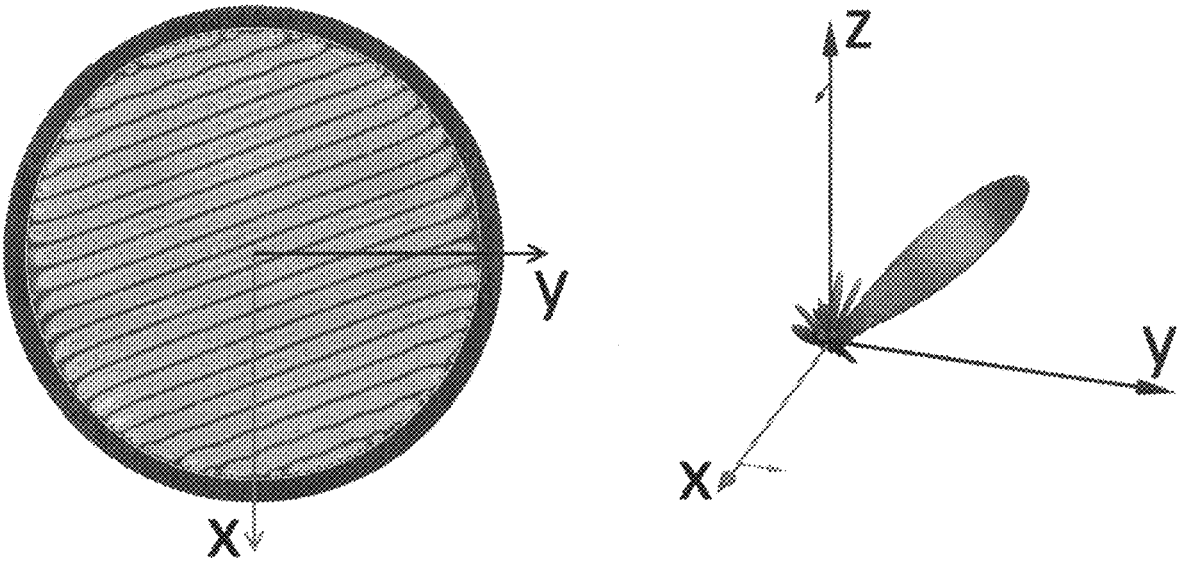
FIG. 8 illustrates an example beam that is formed by a circular-cavity PEX phased array at a tilted angle ($\phi$=100°, $\theta$=45°), and the corresponding plane wave that is formed in the cavity for $\phi$=20°.
Figure 9:
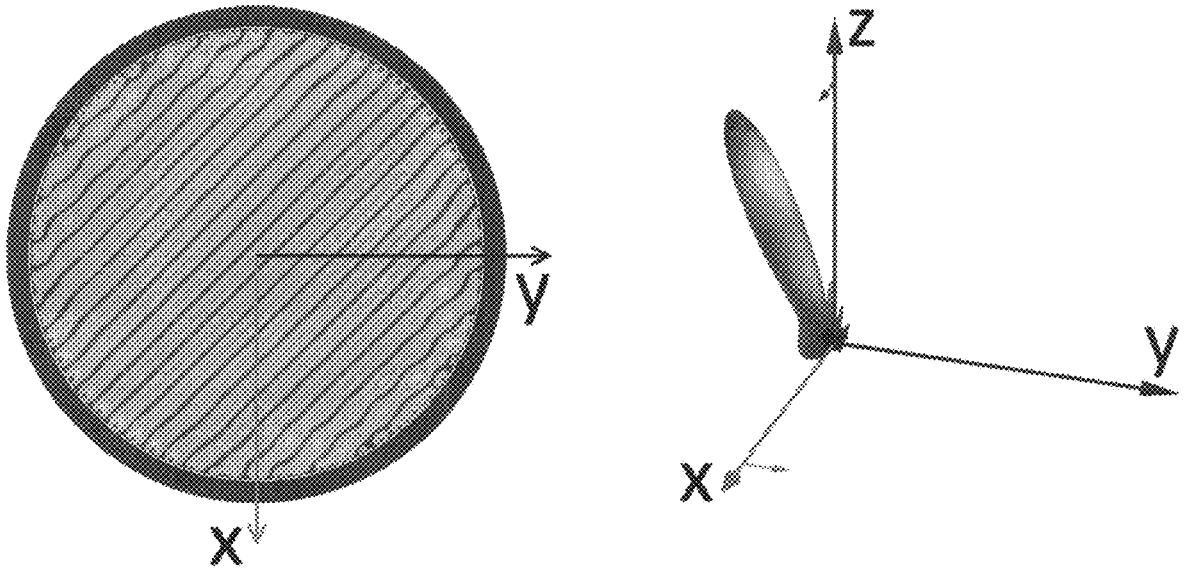
FIG. 9 illustrates an example beam that is formed by a circular-cavity PEX phased array at a tilted angle ($\phi$=225°, $\theta$=57°), and the corresponding plane wave that is formed in the cavity for $\psi$=45°.
Figure 10:
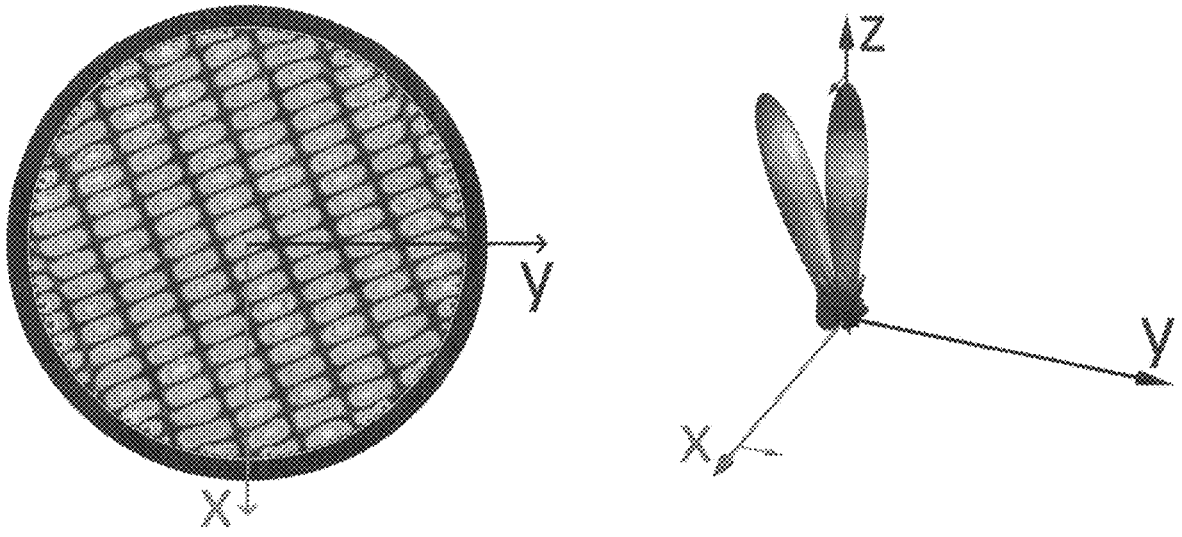
FIG. 10 illustrates an example of two equal beams that are formed by a circular-cavity PEX phased array at broadside ($\phi$=0°, $\theta$=0°) and tilted angle ($\phi$=225°, $\theta$=57°), and the corresponding superposition of plane waves that is formed in the cavity for $\psi_1$=0° and $\psi_2$=45°.
Figure 11:
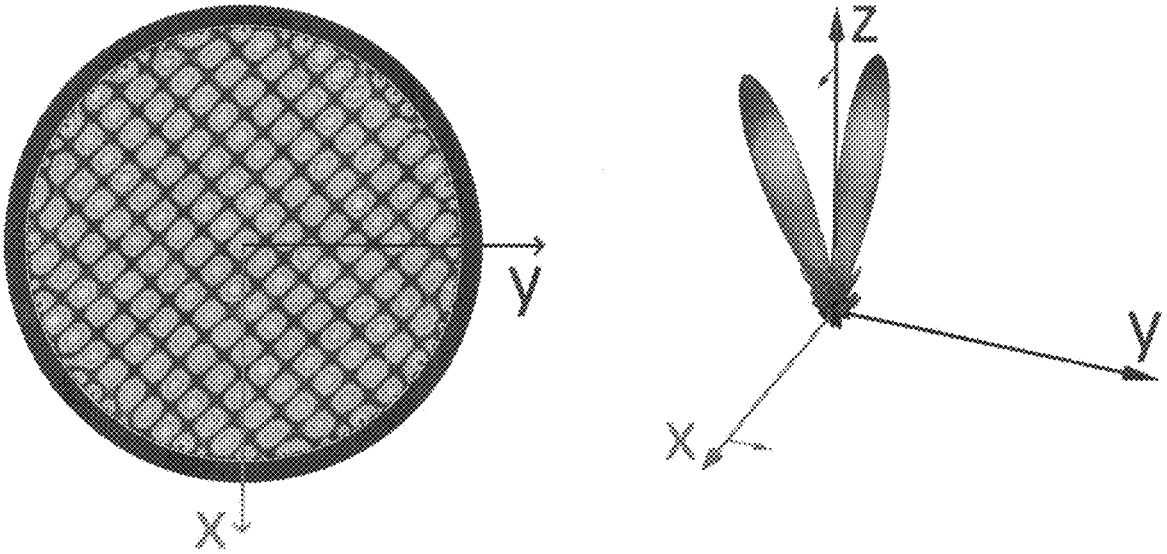
FIG. 11 illustrates an example of two equal beams that are formed by a circular-cavity PEX phased array at tilted angles ($\phi$=275°, $\theta$=21°) and ($\phi$=175°, $\theta$=21°), and the corresponding superposition of plane waves that is formed in the cavity for $\psi_1$=190° and $\psi_2$=260°.
Figure 12:
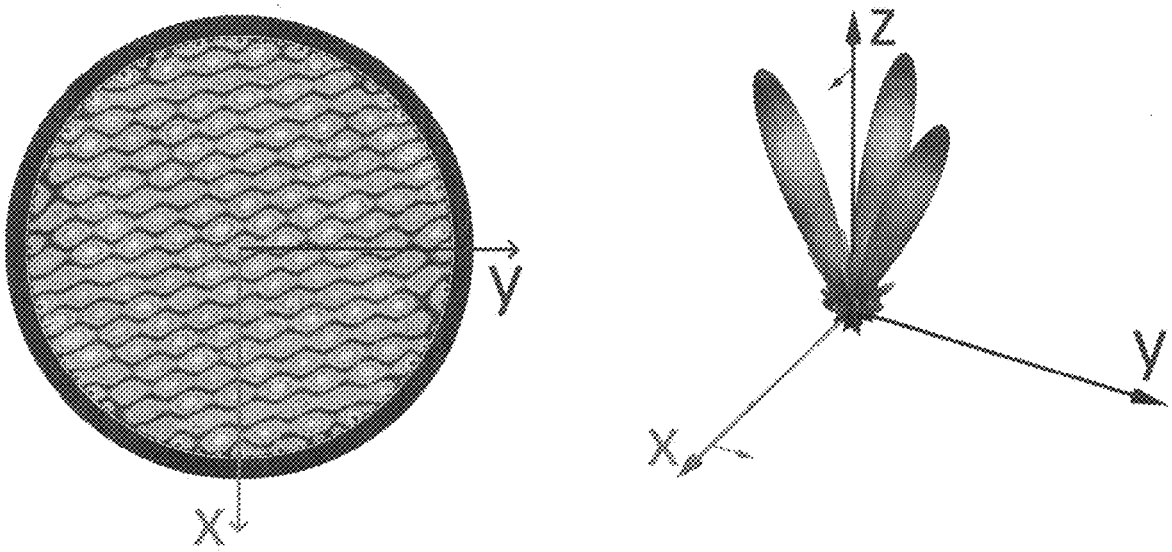
FIG. 12 illustrates an example of three equal beams that are formed by a circular-cavity PEX phased array at tilted angles ($\phi$=95°, $\theta$=21°), ($\phi$=275°, $\theta$=21°), and ($\phi$=175°, $\theta$=21°), and the corresponding superposition of plane waves that is formed in the cavity for $\psi_1$=10°, $\psi_2$=190° and $\psi_3$=260°.
Figure 13:
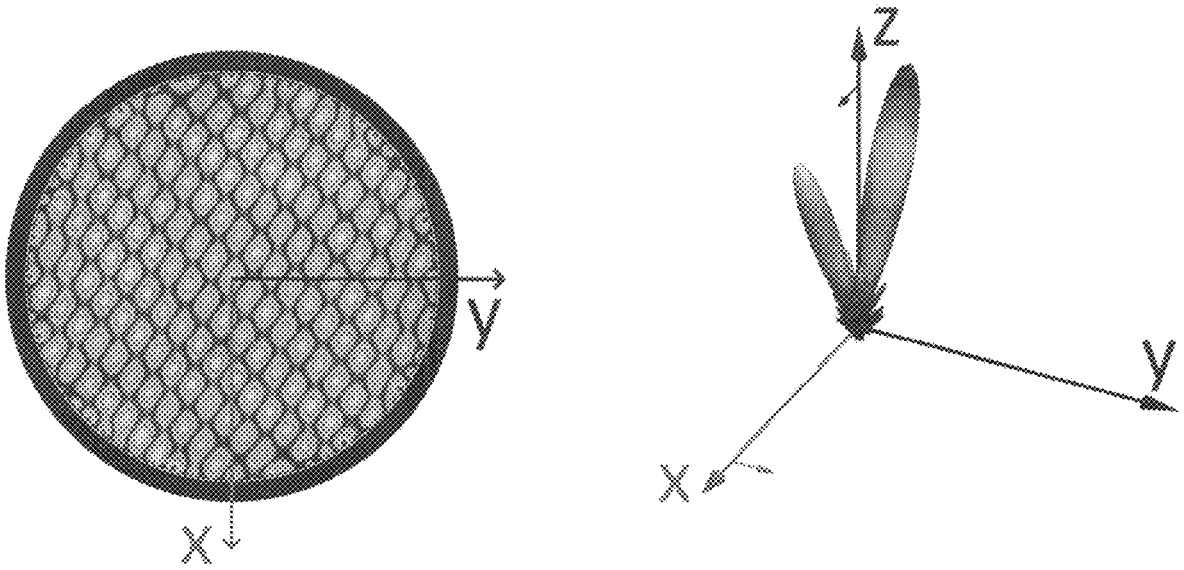
FIG. 13 illustrates an example of two unequal beams that are formed by a circular-cavity PEX phased array at tilted angles ($\phi$=275°, $\theta$=21°), and ($\phi$=175°, $\theta$=21°), and the corresponding superposition of plane waves that is formed in the cavity for $\psi_1$=190° and $\psi_2$=260°.

FIG. 5 illustrates one way to extend the possible range of the beam pointing directions (φ, θ) by situating the PEX cavity 505 on a moving pedestal 540, that is controlled via a simple motor 545. As a result, the generated beam 500 exhibits extended azimuthal and elevation scan ranges.

Another way to extend the possible range of the beam pointing directions (φ, θ) is to, electronically or otherwise, vary the cavity's dielectric permittivity ($\in_r$) 120 or 220. For this purpose, some possible ways include, but not limited to, using ferromagnetic or ferroelectric materials, liquid crystals, and artificial-dielectric materials loaded with tunable electronic elements such as varactors, pin diodes and transistors, among others.

In an example embodiment, a circular cavity is used which is filled with the dielectric 220 being FR-4 ($\in_r$=4.4). The example operating frequency is set to 10 GHz. The top plate of the cavity is perforated with small square apertures having square-grid spacing d=λ, and the spacing between adjacent peripheral sources is p=0.5λ, where λ is the wavelength inside the metallic cavity.

For the circular PEX phased array certain example radiation patterns of the formed beams are illustrated in FIGS. 6-9. The corresponding plane waves in the cavity are also illustrated.

It is also possible by superimposing two or more plane waves inside the PEX cavity to generate multiple beams as shown in FIGS. 10-13. The multiple beams can be of equal strength as in FIGS. 10-12, or of unequal strengths as in FIG. 13. The corresponding waves in the cavity are also illustrated.

All the angles are determined by the weights on the peripheral sources which are, electronically or otherwise, varied. These weights can be varied by phase shifters, transceivers and amplifiers or other suitable means. As a result, arbitrary waves can be excited inside the PEX cavity, and the waves are not limited to one or more plane waves.

It will be appreciated and should be understood that the exemplary embodiments of the invention described above can be implemented in a number of different fashions. Given the teachings of the invention provided herein, one of ordinary skill in the related art will be able to contemplate other implementations of the invention. For example, the symbolic peripheral antenna elements used herein can be implemented actively or passively, in a variety of ways and configurations.

Likewise, the perforations on the top plate can be implemented using arbitrarily shaped apertures, or other radiating elements. Additionally, the shape of the cavity is not limited to square or circular. Other examples would include arbitrary smooth or polygonal cavities. Also, the phase shifters used to excite the peripheral antenna elements can be implemented using a variety of electronic, mechanical and other techniques.

The PEX phased array can be operated in transmit-only, receive-only, or transmit and receive modes. Appropriate amplifiers and transceivers are connected to the peripheral sources depending on the intended mode of operation of the PEX phased array.

Antenna bandwidth may be improved by stacking another radiator (including a substrate) on top of the existing radiator.

Although illustrative embodiments of the present invention have been described herein with reference to the accompanying drawings, it is to be understood that the invention is not limited to those precise embodiments, and that various other changes and modifications may be made by one skilled in the art without departing from the scope of spirit of the invention.

What is claimed is:

1. A phased array antenna comprising: a metallic cavity having a top plate, side walls, and a bottom plate, the cavity filled with a dielectric material having a permittivity of $0 \leq |\in_r| < \infty$; a plurality of periodically-spaced apertures perforating the top plate; a plurality of source antennas disposed only along the periphery of the cavity for exciting the interior volume of the cavity.

2. The phased array antenna of claim 1 wherein the periodic spacing between adjacent apertures is equal to one guided wavelength.

3. The phased array antenna of claim 1 wherein the periodic spacing between adjacent apertures is larger than one guided wavelength to achieve certain beam-forming effects.

4. The phased array antenna of claim 1 wherein the periodic spacing between adjacent apertures is smaller than one guided wavelength to achieve certain beam-forming effects.

5. The phased array of claim 1 that is operated in transmit only, receive only, and simultaneous transmit and receive modes.

6. The phased array of claim 5 wherein the magnitude and phase of the weights of the peripheral source antenna-elements are selected to produce a single steerable beam.

7. The phased array of claim 6 wherein the top plate further comprises varying aperture sizes and shapes for beamshaping functionalities and sidelobe level control.

8. The phased array antenna of claim 7 further comprising below the antenna a moving pedestal controlled by a motor.

9. The phased array antenna of claim 7 wherein the dielectric value of the dielectric filling of the cavity is varied by an external control signal.

10. The phased array of claim 9 wherein the dielectric filling becomes variable using one or more materials selected from the group of materials comprising ferromagnetic materials, ferroelectric materials, liquid crystals, and artificial-dielectric materials loaded with one or more tunable electronic elements selected from the group of tunable electronic elements comprising varactors, pin diodes and transistors.

11. The phased array of claim 5 wherein the magnitude and phase of the weights of the peripheral source antenna-elements are selected to produce multiple independent steerable beams with equal or varying strengths.

12. The phased array of claim 11 wherein the top plate further comprises varying aperture sizes and shapes for beamshaping functionalities and sidelobe level control.

13. The phased array antenna of claim 12 further comprising below the antenna a moving pedestal controlled by a motor.

14. The phased array antenna of claim 12 wherein the dielectric value of the dielectric filling of the cavity is varied by an external control signal.

15. The phased array of claim 14 wherein the dielectric filling becomes variable using one or more materials selected from the group of materials comprising ferromagnetic materials, ferroelectric materials, liquid crystals, and artificial-dielectric materials loaded with one or more tunable electronic elements selected from the group of tunable electronic elements comprising varactors, pin diodes and transistors.

16. The phased array of claim 5 wherein the magnitude and phase of the weights of the peripheral source antenna-elements are selected to produce arbitrary radiation patterns.

17. The phased array of claim 16 wherein the top plate further comprises varying aperture sizes and shapes for beamshaping functionalities and sidelobe level control.

18. The phased array antenna of claim 17 further comprising below the antenna a moving pedestal controlled by a motor.

19. The phased array antenna of claim 17 wherein the dielectric value of the dielectric filling of the cavity is varied by an external control signal.

20. The phased array of claim 19 wherein the dielectric filling becomes variable using one or more materials selected from the group of materials comprising ferromagnetic materials, ferroelectric materials, liquid crystals, and artificial-dielectric materials loaded with one or more tunable electronic elements selected from the group of tunable electronic elements comprising varactors, pin diodes and transistors.

* * * * *